United States Patent [19]

Itoh et al.

[11] Patent Number: 4,810,113

[45] Date of Patent: Mar. 7, 1989

[54] PRINT HEAD DRIVING SYSTEM

[75] Inventors: Toshikazu Itoh; Satoru Tsuchiya, both of Tokyo, Japan

[73] Assignee: Oki Electric Industry Co., Ltd., Tokyo, Japan

[21] Appl. No.: 77,867

[22] Filed: Jul. 27, 1987

[30] Foreign Application Priority Data

Aug. 15, 1986 [JP] Japan ..... 61-190572

[51] Int. Cl.[4] ..... B41J 7/92; B41J 9/38

[52] U.S. Cl. ..... 400/124; 400/166; 101/93.03; 101/93.02

[58] Field of Search ..... 400/54, 121, 124, 166, 400/167, 157.3, 157.2; 101/93.03, 93.04

[56] References Cited

U.S. PATENT DOCUMENTS 4,627,344 12/1986 Costello ..... 101/93.03 X

FOREIGN PATENT DOCUMENTS 163671 9/1983 Japan ..... 400/166

*Primary Examiner*—Paul T. Sewell

*Attorney, Agent, or Firm*—Wenderoth, Lind & Ponack

[57] ABSTRACT

A print head driving system for driving a print head having a plurality of print wire controlling magnetic circuits and a plurality of print wires respectively operatively associated with the print wire controlling magnetic circuits regulates the flight starting timing of the print wires through the regulation of respective timings for supplying driving currents to the print wire controlling magnetic circuits to be used for a preceding printing cycle and the print wire controlling magnetic circuits to be used for a succeeding printing cycle, according to control data calculated on the basis of the number of the print wires which were used for the preceding printing cycle and the number of the print wires to be used for the succeeding printing cycle so that dots are printed at expected positions to thereby provide a clear print.

1 Claim, 6 Drawing Sheets

PRINT HEAD DRIVING SYSTEM

BACKGROUND OF THE INVENTION

1. Field of the Invention

The present invention relates to a printing head driving system for driving a print head for a serial printer and, more specifically, to a print head driving system for driving a print head having magnetic circuits which are driven to actuate corresponding print wires for printing.

2. Description of the Prior Art

A conventional print head driving system of such a kind will be described hereinafter with reference to FIGS. 4(A) to 4(C), FIGS. 5(A) to 5(C), FIG. 6 and FIG. 7.

FIGS. 4(A) to 4(C) illustrate the relationship between the arrangement of print wires in the front surface of a printing head, and dot matrices printed with the print wires.

In printing dot patterns with a single column of a plurality of print wires 1, for example, eight print wires as shown in FIG. 4(A), through an ink ribbon (not shown) on a recording sheet (not shown), it is normal to print one character in a full matrix having eight dots 2 in a line (a line along the direction of movement of the print head) as shown in FIG. 4(B) or in a pseude matrix having twelve dots 2 in a line as shown in FIG. 4(C).

The constitution of such a print head and the action of the print wires 1 will be described briefly. In the print head, each print wire 1 is attached to an armature supported on a spring plate; a core wound with a driving coil is disposed opposite to the armature with a gap therebetween; the armatures, the driving coils and the cores are arranged in a circular or elliptic arrangement, and a common permanent magnet is provided around the circular or elliptic arrangement of the cores.

Normally, the armature is attracted to the core by the magnetism of the permanent magnet to warp the spring plate. A driving current is supplied selectively to the driving coil to energize the driving coil selectively. The core associated with the energized driving coil is magnetized in a polarity to cancel the magnetism of the permanent magnet, so that the spring plate is allowed so as to release itself from the core by its own resilience and the print wire 1 thereby makes flight for printing action to print a dot.

The print speed of a serial printer provided with such a print head is dependent on the response frequency of the print wires of the print head. Therefore, the print speed of the serial printer can be enhanced by increasing the minimum dot pitch between dots printed with the same print wire during the lateral movement of the print head.

Another printing system using two columns of print wires as shown in FIG. 5(A) has been employed to enhance the print speed. As shown in FIG. 5(A), fourteen print wires 1 are arranged in the front surface of a print head in two columns spaced at a distance In printing a character "A" as shown in FIG. 4(C) while the print head is moved laterally, the dots 2 of columns 1, 2, 5, 6, and 9 are printed with the print wires 1 of the right column, while the dots 2 of columns 3, 4, 7, and 8 are printed with the print wires 1 of the left column. Columns 10 to 12 correspond to a clearance between adjacent characters, namely, a non-print area. As is obvious from FIGS. 5(B) and 5(C) showing the respective positions of the dots 2 printed with the print wires 1 in the above-mentioned printing manner, the distance d between the laterally successive dots 2 is twice the distance D between the laterally successive dots 2 printed with a single column of print wires 1 as shown in FIG. 4(C). Accordingly, the print speed of a print head provided with two columns of print wires 1 can be twice that of a print head provided with a single column of print wires 1.

In a serial printer equipped with a print head provided with two columns of print wires 1, the print head is driven at moments determined by predetermined timing on the basis of a dot pulse detected once every step of movement of a carrier mounted with the print head by a distance corresponding to D/2.

FIG. 6 is a time chart showing print head drive timing, waveforms of driving currents and the flight of print wires 1. In FIG. 6, drive timings I and II are a preceding drive timing and a succeeding drive timing, respectively, of actuating print wires 1, driving currents I and II are currents supplied to the driving coils corresponding to the print wires 1 to actuate the print wires 1 at moments determined by the drive timings I and II, respectively, and wire displacements I and II are the displacements of the print wires 1 when the driving currents are supplied to the corresponding driving coils at moments determined by the drive timings I and II, respectively.

Such a conventional print head driving system is capable of driving a print head for printing operation at a high print speed and in high print quality when the print head is comparatively large or the number of the print wires mounted on the print head is comparatively small. However, when the print head is comparatively small and has a comparatively large number of print wires, the print speed is usually reduced and the print quality is deteriorated due to magnetic interference between the magnetic circuits each including the armature, the driving coil and the core. Causes of such problems can be explained with reference to FIGS. 6 and 7.

Referring to FIG. 6, when the driving current I is supplied to a driving coil of a magnetic circuit included in a group of magnetic circuits driven by the preceding drive timing I to actuate the corresponding print wire 1 for the printing displacement I, and the driving current II is supplied subsequently to a driving coil of a magnetic circuit included in a group of magnetic circuits driven by the succeeding drive timing II to actuate the corresponding print wire 1 for the printing displacement II, the flight time, namely, time from the start of action of the print wire 1 to the arrival of the same at a print position on a recording sheet, for the displacement II increases and the starting time is delayed as indicated by broken lines because the driving time, namely, the duration of supply of the driving current I, is longer than the time interval between the driving timings I and II. Consequently, the succeeding dot 2 is dislocated from an expected position to a wrong position of a dot 2*a* indicated by a broken line, and hence the print speed needs to be reduced necessarily, or the print quality is deteriorated.

SUMMARY OF THE INVENTION

Accordingly, it is a object of the present invention to provide a print head driving system which enables a print head having a compact construction and equipped with a comparatively large number of print wires, not to mention a comparatively large print head, to operate at a high print speed and to print with a satisfactory print quality.

In brief, the present invention contemplates a print head driving system for a printer in which the magnetic circuits of a print head are driven individually by overlapping drive currents to allow the corresponding print wires to make flight for printing, comprising a first memory means for storing the number of print wires which has been caused to make flight by magnetic circuits driven by preceding drive timing, a second memory means for storing the number of print wires which are to be caused to make flight by magnetic circuits driven by a succeeding drive timing, an arithmetic means for calculating flight timing correcting times, and a timing means.

According to the present invention, flight timing correcting times are calculated on the basis of data stored in the first and second memory means, and then the succeeding drive timing for driving the magnetic circuits is delayed by the flight timing correcting time by means of the timing means to shift a predetermined flight timing of the print wires controlled by the magnetic circuits driven by the succeeding drive timing. Accordingly, the influence of interference between the magnetic circuits on the printing action of the print wires is eliminated almost completely, only a slight dislocation of dots occurs, and hence the print speed of the print head can be enhanced and the print quality is improved.

The above and other objects, features and advantages of the present invention will become apparent from the following description taken in conjunction with the accompanying drawings.

DESCRIPTION OF THE PREFERRED EMBODIMENT

A print head driving system, in a preferred embodiment, according to the present invention will be described hereinafter with reference to the accompanying drawings.

Figure 1:
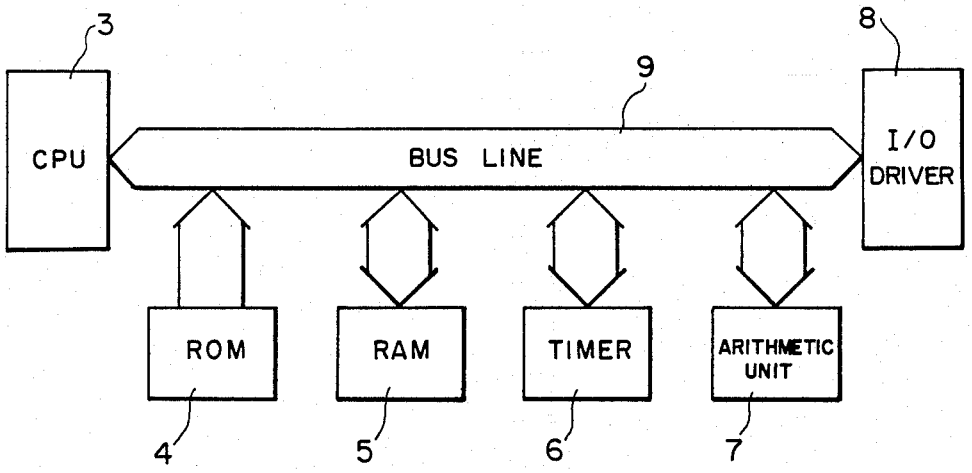
FIG. 1 is a block diagram of a print control circuit of a print head driving system, in a preferred embodiment, according to the present invention.

Referring to FIG. 1, there are shown a central processing unit (hereinafter referred to as a "CPU") 3, a read-only memory (hereinafter referred to as a "ROM") 4 for storing predetermined data including a control program and dot patterns, a random access memory (hereinafter referred to as a "RAM") 5 for storing print data given thereto from an external input means, a timer 6 serving as a timing means, an arithmetic unit 7 which computes a flight time correction for correcting the flight time of a print wire in response to an instruction given thereto from the CPU 3, and a bus line 9 interconnecting the CPU 3, the ROM 4, the RAM 5, the timer 6, the arithmetic unit 7 and the I/O driver 8. The arithmetic unit 7 comprises a first register and a second register as an internal memory means. A power source (not shown) for driving the driving coils of a print head (not shown) and reciprocating a carriage (not shown) mounted with the print head is connected to the I/O driver.

The CPU 3 receives print data, namely, character data, and control data, namely, control codes, including a character pitch and a line feed command through the I/O driver 8 and an interface (not shown) from external input means according to the control program stored in the ROM 4 and stores those received data. Upon the reception of print data for one line by the RAM 5, the CPU 3 reads the print data from the RAM 5 and gives the print data to the I/O driver 8, and then the I/O driver 8 drives the print head to print out the print data.

A printing operation is executed both during the forward travel and during the return travel of the carriage mounted with the print head along the platen supporting a recording sheet substantially over the entire print span. A dot pulse is detected once every movement of the carriage over a distance corresponding to the print span. The printing operation is controlled by a pulse signal having a time width necessary for driving the print wire from the detection of the dot pulse, namely, a drive timing signal.

Figure 2:
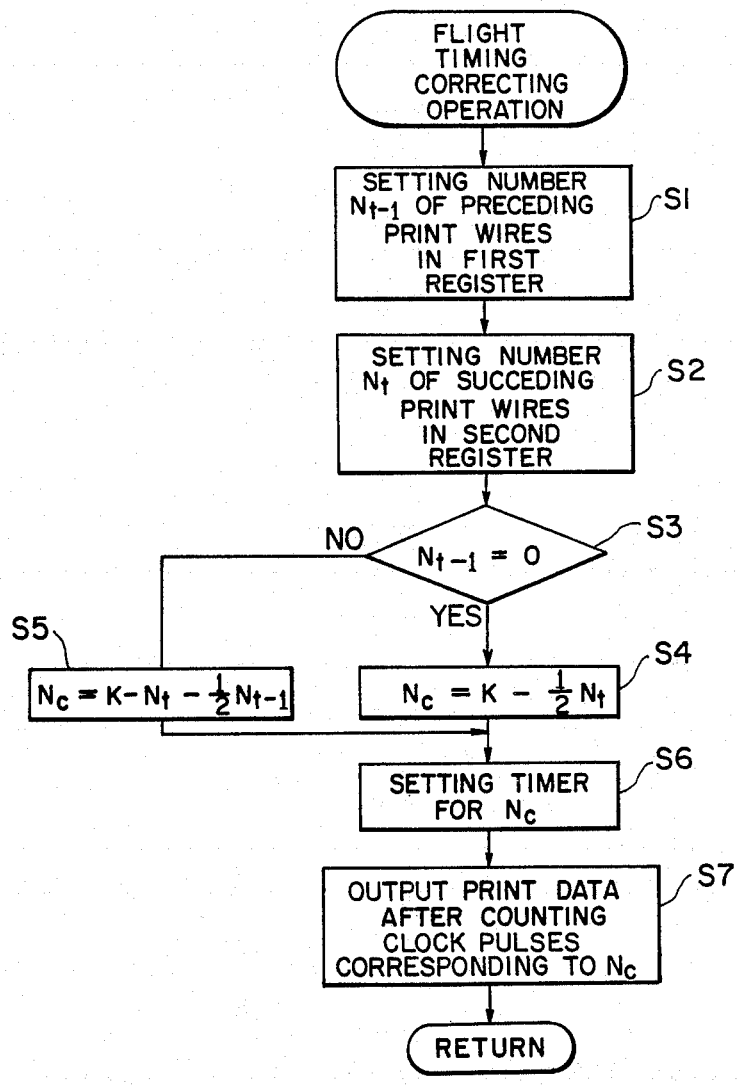
FIG. 2 is flowchart showing a process of operation of the print head driving system of FIG. 1 for computing a flight time correction time.

Functions of the print head driving system will be described hereinafter with reference to FIG. 2. Upon the completion of printing out a print data by the print head and movement of the carriage by a distance corresponding to a print pitch, a dot pulse is detected. Then, the CPU 3 outputs a print timing signal based on the dot pulse to the arithmetic unit 7. At step S1, the arithmetic unit 7 stores the number $N_{t-1}$ of the print wires used for the preceding printing cycle in the first register, and then the arithmetic unit 7 stores the number $N_t$ of the print wires to be used for the succeeding printing cycle in the second register at step S2. At step S3, the arithmetic unit 7 makes a decision as to whether or not the number $N_{t-1}$ is zero. When $N_{t-1}=0$, the arithmetic unit 7 calculates an internal flight timer setting value $N_c$ at step S4 by using an equation:

$$N_c=K-N_t/2\ (K\geqq N_t/2)\ldots \quad (1)$$

When the decision at step S3 is $N_{t-1}\neq 0$, the arithmetic unit 7 calculates an internal flight timer setting value $N_c$ at step S5 by using an equation:

$$N_c=K-(N_t+N_{t-1}/2)\ (K\geqq N_t+N_{t-1}/2)\ldots \quad (2)$$

Thus, equation (1) is used for setting a larger flight time correction when the number of the print wires to be used for the succeeding printing cycle is smaller in case no print wire is used in the preceding printing cycle, namely, in case the succeeding printing cycle is to be executed after a blank space, while equation (2) is used for setting a smaller flight time correction when the number of the print wires to be used for the succeeding printing cycle is greater in case some print wires have been used in the preceding printing cycle. In equations (1) and (2), K is a constant specific to the characteristics of the print head.

At step S6, the timer 6 is set for the internal flight timer setting value Nc calculated by equation (1) or (2). At step 7, after clock pulses corresponding to $N_c$ have been counted by the timer 6, the CPU 3 outputs print data to the I/O driver 8, and the driving coils of the magnetic circuits corresponding to the print data are thereby driven to actuate the corresponding print wires for printing action to print dots corresponding to the print data.

Figure 3:
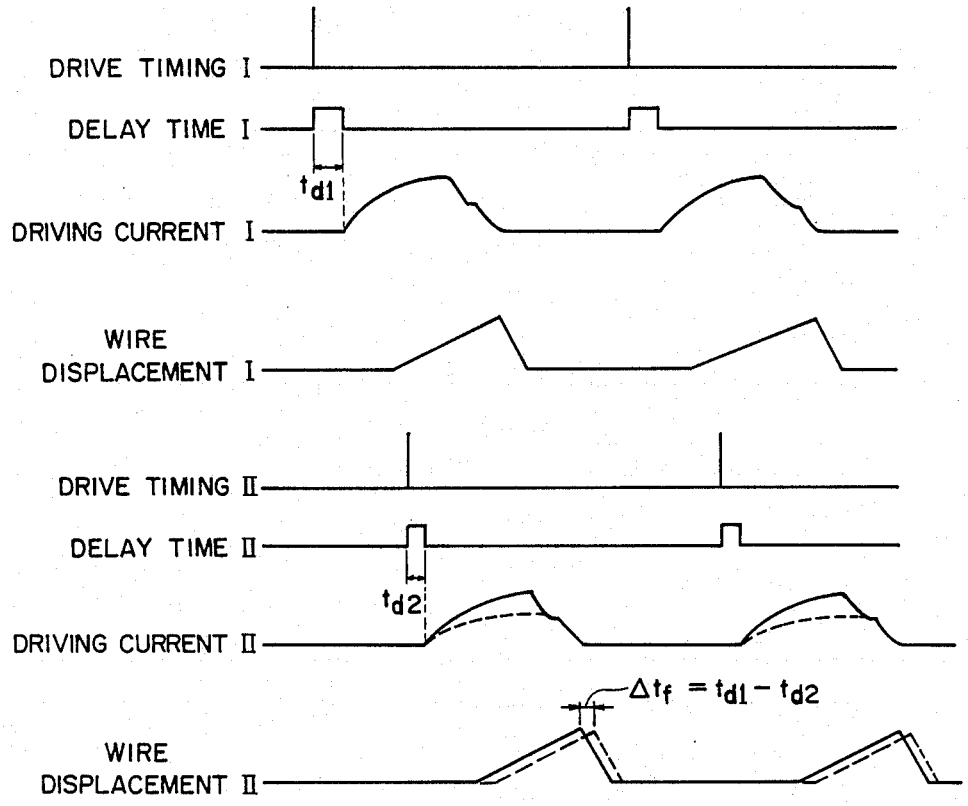
FIG. 3 is a time chart showing a print head driving mode of the print head driving system of FIG. 1.
Figure 4:
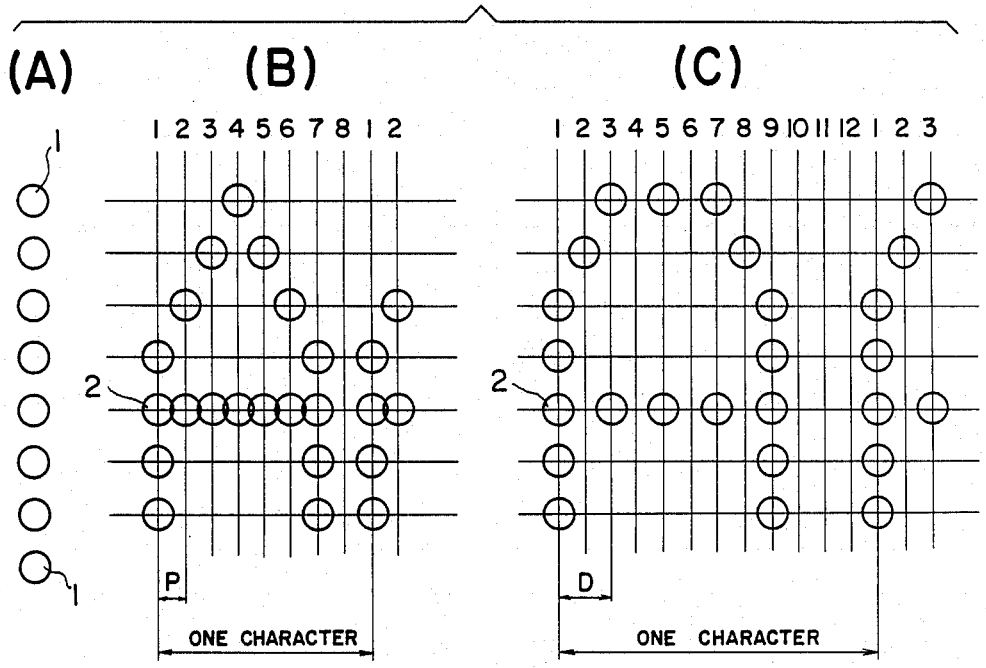
FIG. 4 (PRIOR ART)
FIGS. 4(A), 4(B), and 4(C) are diagrammatic illustrations showing the relationship between an arrangement of conventional print wires and dot patterns.
Figure 5:
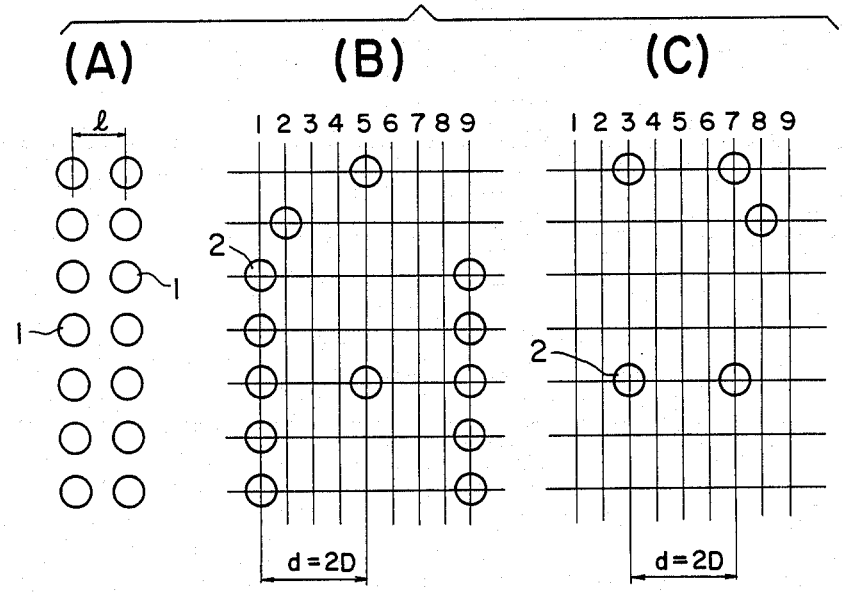
FIG. 5 (PRIOR ART)
FIGS. 5(A), 5(B), and 5(C) are diagrammatic illustrations showing the relationship between another arrangement of conventional print wires and dot patterns.

Referring to FIG. 3 showing a print wire actuating mode, $t_{d1}$ and $t_{d2}$ are delay times I and II for correcting errors in the action of the print wires due to magnetic interference. The magnitudes of the delay times I and II are dependent on the number of the print wires to be used. The delay times I and II correspond to the values calculated at steps S4 and S5, respectively. Drive timings I and II, driving currents I and II and print wire displacement I and II in FIG. 3 are the same as those in FIG. 6, respectively.

Figure 6:
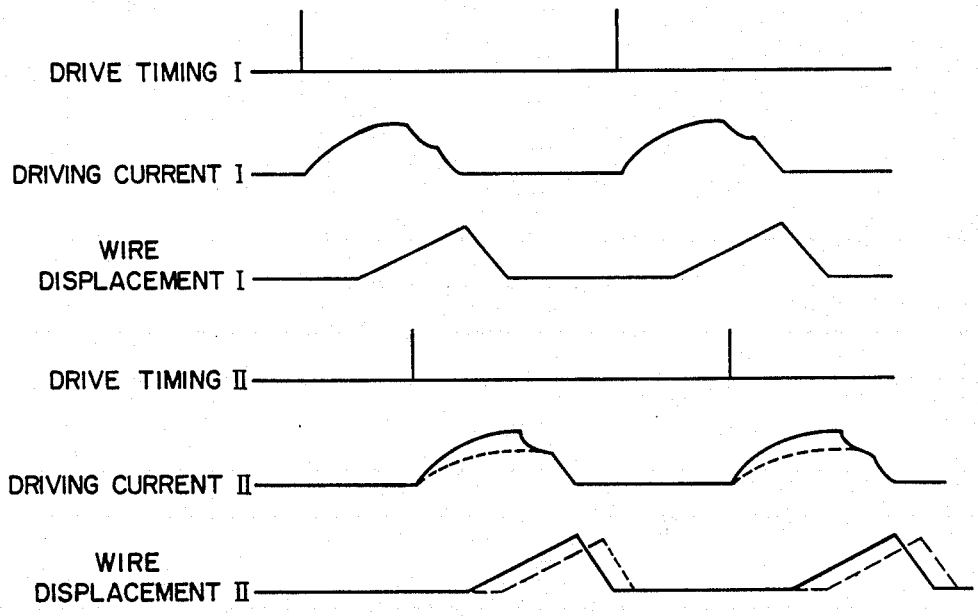
FIG. 6 (PRIOR ART)
FIG. 6 is a time chart showing a print head driving mode of a conventional print head driving system.
Figure 7:
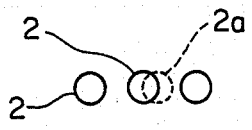
FIG. 7 (PRIOR ART)
FIG. 7 is an illustration showing the dislocation of a dot from the correct position in a conventional print head driving system.

As shown in FIG. 6, the preceding drive timing I is delayed by the delay time I, namely, the delay time $t_{d1}$, corresponding to the delay time in the flight of the print wires when the corresponding coils are driven at a moment determined by the preceding drive timing I, and then the succeeding drive timing II is delayed by the delay time II, namely, the delay time $t_{d2}$ so that the drive current II overlapping the drive current I is supplied to the coils corresponding to the print wires for the succeeding printing. Consequently, the relative dislocation of dots are corrected almost completely. That is, a time delay $\Delta t_f = t_{d1} - t_{d2}$ in the completion of the flight of the print wires is smaller than that of print wires driven by the conventional print head driving system shown in FIG. 6.

Although the first register and the second register are internal registers of the arithmetic unit 7 in this embodiment, the first register and the second register may be external registers.

Although the present invention has been described in its preferred form with a certain degree of particularity, as many widely different embodiments of this invention may be made without departing from the spirit and scope thereof, it is to be understood that the invention is not limited to the specific embodiments thereof except as defined in the appended claims.

What is claimed is:

1. A print head driving system for application to driving a print head comprising a plurality of print wires, and a plurality of print wire controlling magnetic circuits respectively associated with the print wires and individually driven by overlapping driving currents so as to make the associated print wires make flight for printing action, which comprises:

a first memory means for storing data representing the number of the print wires made to make flight by the print wire controlling magnetic circuits which have been driven by a driving current supplied thereto at a moment determined by a preceding drive timing;

a second memory means for storing data representing the number of the print wires which are to be made to make flight by the print wire controlling magnetic circuits to be driven by a driving current to be supplied thereto at a moment determined by a succeeding drive timing;

an arithmetic means for calculating, on the basis of the data stored in the first and second memory means, flight start timing regulating data for regulating the flight start timing of the print wires so that dots are printed at correct positions; and a timing means for delaying timings for supplying the driving current to the print wire controlling magnetic circuits by times respectively corresponding to the flight start timing regulating data calculated by the arithmetic means.

* * * * *